United States Patent [19]

Gullickson

[11] Patent Number: 4,640,021

[45] Date of Patent: Feb. 3, 1987

[54] HAY DRYING APPARATUS

[76] Inventor: M. Roy Gullickson, P.O. Box 70, Barons, Alberta, T0L 0G0, Canada

[21] Appl. No.: 734,491

[22] Filed: May 16, 1985

[51] Int. Cl.[4] ..... F26B 5/12

[52] U.S. Cl. ..... 34/15; 34/38; 34/92; 34/243 R

[58] Field of Search ..... 34/92, 15, 202, 241, 34/243 R, 38

[56] References Cited

U.S. PATENT DOCUMENTS

| | | | |
|---|---|---|---|
| 61,393 | 1/1867 | Burns | 34/233 |
| 116,969 | 7/1871 | Lear | 34/16.5 |
| 288,243 | 11/1883 | Kendall | 34/38 |
| 1,303,945 | 5/1919 | Nichols | 34/243 R |
| 2,442,344 | 6/1948 | Curtis | 34/233 |
| 2,443,865 | 6/1948 | Moffett | 34/233 |
| 2,502,205 | 3/1950 | Collins et al. | 98/52 |
| 2,532,530 | 12/1950 | Anderson et al. | 34/214 |
| 3,280,473 | 10/1966 | Sullivan | 34/91 |
| 3,324,846 | 6/1967 | Smith | 34/243 R |
| 4,017,981 | 4/1977 | Invaldsen | 34/26 |

*Primary Examiner*—Albert J. Makay
*Assistant Examiner*—David W. Westphal
*Attorney, Agent, or Firm*—Carver & Co.

[57] ABSTRACT

An apparatus for drying a stack of hay bales which includes a movable dryer for placement against a first end of the stack and an air and moisture impervious flexible sheet for covering the dryer and a top and sides of the stack. An air fan coupled to the dryer is operable to draw air through the stack from an open thereof into the dryer and to discharge the air from the dryer to atmosphere.

16 Claims, 2 Drawing Figures

HAY DRYING APPARATUS

FIELD

The present invention relates to an apparatus for drying stacks of hay bales and other crops, such as grass, alfalfa and the like which may be stacked in bales.

BACKGROUND OF THE INVENTION

Several forms of agricultural crops, such as hay, grass, alfalfa, grain, etc. which have a high moisture content require drying prior to storage in order to prevent fermentation and putrefaction. It is known that by drying such crops prior to storage, substantially improved storage life is obtained. For example, newly cut grass has a moisture content of approximately 80% of its weight. To maintain its quality, the dried young grass must be dehydrated to a point where the moisture content is approximately 12% of its weight whereas for hay the moisture content must be no more than approximately 20% of its weight. The normal method of drying grass or hay is to pass air either heated or unheated through a bed of the crop in order to carry away excess moisture. Such drying has not hitherto been common due to the requirement of having to move the product into and out of the drying apparatus as well as, in many cases, the relatively large expense of the drying apparatus itself. For example, a common type of drying apparatus includes a floor duct system upon which the crop must be placed in order to allow air to be forced through the crop. Following drying, the dried crop must then be removed and placed into storage.

U.S. Pat. No. 4,017,981 issued Apr. 19, 1977 to Ingvaldsen discloses a pyramidal grid covering a blower located on the ground and an air exhaust line leading from the blower to an air inlet. The crop is stacked over the grid and air is drawn in through the inlet, past a heater, out through the grid and through the crop.

U.S. Pat. No. 2,442,344, issued June 1, 1948 to Curtis, U.S. Pat. No. 2,532,530 issued Dec. 5, 1950 to Anderson, U.S. Pat. No. 2,443,865 issued June 22, 1948 to Moffett and U.S. Pat. No. 61,393 issued Jan. 22, 1867 to Burns, all disclose dryers which include a wagon with a grid affixed to the floor thereof into which a crop is placed for drying. Following drying, the dried crop is then removed and placed into storage.

U.S. Pat. No. 3,280,473 issued Oct. 25, 1966 to Sullivan discloses a circular grid raised above a plenum formed between the grid, a circular wall having six wall apertures and the ground for supporting the crop. A conical air and moisture impervious cover extends from the upper periphery of the wall over the crop to an upper air aperture. The aperture is coupled by a flexible duct to an exhaust fan and air is drawn through the wall apertures, into the plenum, up through the grid and crop and out the flexible duct.

U.S. Pat. No. 2,502,205 issued to Collins describes a method of curing bales of hay by forming tunnels in each stack to permit subsequent circulation of air therethrough by a portable air moving apparatus. The tunnels are formed by a deflatable rib-like structure that is placed on the ground prior to stacking the hay and because of the weight of the stack of hay, formation of the tunnel structure in the bottom of the stack is developed. Following completion of the stacking operation, the tunnel forming apparatus is deflated and removed. The portable air moving apparatus is then coupled to an open end of the tunnel and transmits air into the latter which gravitates up through the stack and dries the latter.

Except for Collins, each of the foregoing apparatus requires placement of the crop into a drying apparatus, drying the crop in the apparatus and then subsequently removing and storing the dried crop. Even devices used for tunnelling a stack of hay involve the step of first forming the tunnel and then coupling to the tunnel the portable air moving device. Considering that in particular for hay there are standard forms of bales that are paroduced by commonly used machinery, the requirement of having to form tunnels in the bales is an extra time consuming and therefore expensive step.

SUMMARY OF THE INVENTION

According to the invention there is provided an apparatus for drying a stack of hay bales which includes a movable dryer for movement against and enclosing a first end of the stack, an air impermeable flexible sheet covering a top and sides of the stack and the dryer and an air fan coupled to the dryer operable to draw air from the atmosphere into an open end of said stack and to exhaust the air to atmosphere out of the first end of the stack. Thus, the air is drawn through the open end of the stack through the stack where it picks up moisture and then is exhausted by the fan, leaving the first end of the stack. It is thus not necessary to move the stack of hay bales in order to accomplish drying of the latter nor is it necessary to carry out any prior opertions, such as formation of a tunnel in the bottom of the stack. The operation is applicable whether or not the stacks of hay bales are rectangular in nature or are large round bales.

Preferably the dryer includes a wheeled framework covered with airtight cloth having a chamber formed between the cloth and an end of a haystack when the dryer is in place against the latter end.

Preferably the dryer framework is foldable for ease of both transportation and storage.

In an alternative aspect of the invention there is provided a method of drying a stack of hay bales which includes covering a first end, top and sides of the stack and then drawing air out from the first end of the stack.

The method may include forming a plenum chamber substantially coextensive with a first end of the stack and exhausting air from the plenum.

The invention will be now further described, reference being has to the accompanying drawings.

BRIEF DESCRIPTION OF THE DRAWINGS

In drawings of a preferred embodiment of the invention.

DETAILED DESCRIPTION WITH REFERENCE TO THE DRAWINGS

Figure 1:
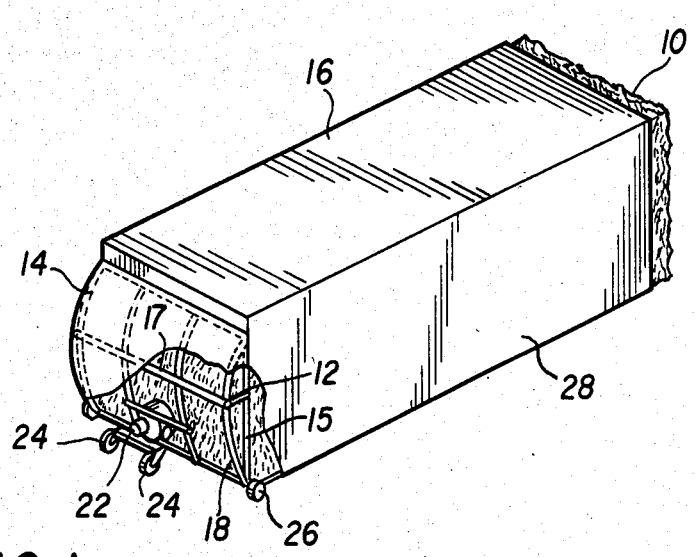
FIG. 1 is a perspective view of the dryer in place over a stack of hay bales.

The hay drying apparatus shown in FIG. 1 consists of a frame assembly 12 which includes an upright rectangular frame 15 joined on one side by a pluriality of vertically oriented spaced apart arcuate frame elements 18. The arcuate elements 18 and the vertical elements of the rectangular frame 15 are joined midway by support elements 17. To the bottom of the frame assembly 12, centrally thereof there is mounted an air fan assembly 22 which is also supported by wheels 24.

Figure 2:
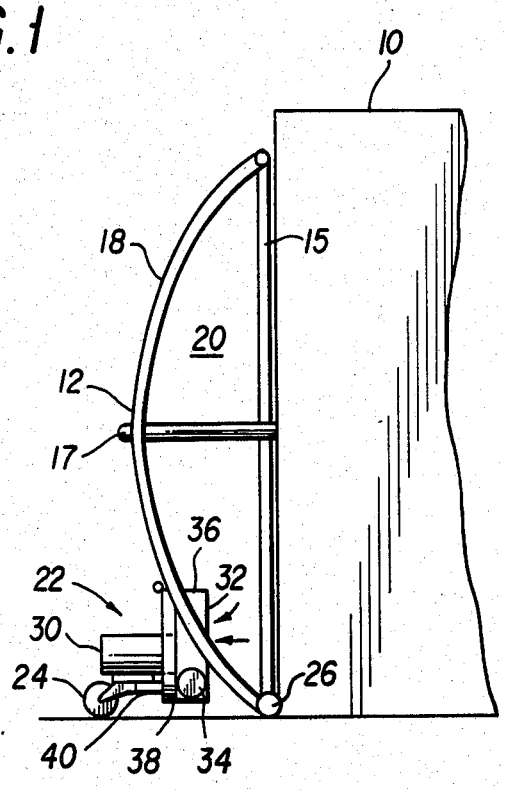
FIG. 2 is a side elevation view of the dryer with the airtight cloth around the dryer framework removed.

As shown in FIG. 2, the air fan assembly 22 consists of an axial or centrifugal air fan motor 30 coupled to a fan (not shown) located within a fan housing 36. Fan housing 36 has an inlet 32 located within the interior of frame assembly 12 and an air outlet 34 located exterior to the frame assembly 12. A support frame 38 affixed to frame assembly 12 supports the housing 36 as well as a motor support 40. Wheels 24 are journalled to the support 40. An airtight flexible fabric 14 is used to cover the exterior of frame assembly 12, including enclosure of housing 36 around inlet 32 so as to form a chamber 20 when the frame assembly abuts an end of a stack of hay 10. Air and moisture impervious top and side plastic sheets 16 and 28, respectively cover the top and two sides of the stack 10, thereby forming an airtight and moisture impervious enclosure about the stack with only one end thereof open to the atmosphere.

In use, stacks of hay bales 10 which may either be rectangular or rounded are placed in a convenient storage location. Frame assembly 12 including fan assembly 22 are wheeled adjacent one end of the stack 10 and placed in abutting relationship thereto. Plastic sheets 16 and 28 which cover to the rectangular frame 15 are then drawn over the top and two sides of the stack 10, leaving one end thereof open. Upon operation of the fan assembly 22, chamber 20 is evacuated and begins to draw air through the stack 10 from an open end thereof to the chamber 20. At the same time the vacuum developed in chamber 20 causes the fabric 14 to seal against frame assembly 12. Air which passes from the atmosphere into the open end of the stack 10 and through the stack, picks up the excess moisture from the hay and carries it out into the chamber 20 from which it is exhausted to atmosphere by fan assembly 22. Initially, only hay near the open of stack 10 is dried, since the air passing through the stack becomes saturated with moisture before it reaches chamber 20. The drying zone then advances towards the chamber 20 and eventually succeeds in drying out the whole of the stack 10.

Upon completion of drying, plastic covers 16 and 28 are withdrawn and the assembly may then be easily and quickly moved to another stack to repeat the operation.

Other variations, modifications and departures lying within the spirit of the invention and scope as defined by the appended claims will be obvious to those skilled in the art.

I claim:

1. Apparatus for drying a stck of hay bales, comprising:

(a) a moveable dryer for placement against a first end of said stack said dryer including a framework covered with air-tight cloth having a chamber formed in the interior thereof when abutting an an end of said stack;

(b) an air and moisture impervious flexible sheet for covering said dryer and a top and sides of sadi stack; and (c) an air fan coupled to said dryer operable to draw air through said stack from an open end thereof into said dryer and to discharge air in said dryer to atmosphere.

2. Apparatus as defined by claim 1, wherein said dryer includes a framework covered with airtight cloth having a chamber formed in the interior thereof when abutting an end of said stack.

3. Apparatus as defined by claim 2, wherein said framework is wheeled and is substantially coextensive with an end of said stack.

4. Apparatus as defined by claim 3, wherein said framework is foldable for facilitating transport and storage.

5. A method of drying a stack of hay bales, including covering a first end, top and sides of said stack, leaving a second end uncovered, forming a chamber substantially co-extensive with said first end and exhausting air from said chamber such that air enters said stack from the second end thereof, passes through the stack and exits out of the first end.

6. An apparatus for drying a stack of hay bales, comprising:

a collecting member having a recess shaped to form a chamber between an end of the stack and the collecting member when the collecting member is against the end of the stack;

an air fan mounted on the member having an inlet communicating with the recess to draw air from the chamber and an outlet exterior to the recess; and means for supporting the collecting member in a substantially vertical position against the end of the stack of hay.

7. An apparatus as claimed in claim 6, wherein the collecting member is covered with an air-tight material.

8. An apparatus as claimed in claim 7, wherein the collecting member includes a supporting frame and an air-tight flexible covering for the frame.

9. An apparatus as claimed in claim 7, wherein the collecting member is concave on a side for facing the stack of hay to form the recess.

10. An apparatus as claimed in claim 8, wherein the frame has a plurality of spaced-apart veritcal members, the vertical members being arcuate to form the recess.

11. An apparatus as claimed in claim 6, wherein the collecting member has a bottom, the means for supporting including wheels rotatably mounted on the bottom of the collecting member.

12. An apparatus as claimed in claim 6, wherein the collecting member has a co-planar periphery for contacting the end of the stack.

13. An apparatus as claimed in claim 12, wherein the perphery encloses an area substantially larger than the inlet and the outlet.

14. An apparatus as claimed in claim 13, wherein the periphery encloses an area large enough to cover the ends of a plurality of bales of hay in a said stack.

15. In combination, a stack formed form a plurality of bales of hay having a top, sides and a substantially vertical and co-planar end and an apparatus for drying the stack of hay bales, the apparatus comprising a collecting member having a recess to form a chamber between the end of the stack and the collecting member when the collecting member is against the end of the stack, the collecting member covering substantially all of said end of said stack; an air fan mounted on the member having an inlet communicating with the recess to draw air from the chamber and an outlet exterior to the recess; means for supporting the collecting member in a substantially vertical position against the end of the stack of hay; and means for covering the top and sides of the stack with an ait-tight material.

16. A method of drying bales of hay, comprising:

piling the bales into a stack having a top, sides and opposite ends;

providing a collecting member substantially co-extensive with one end of the stack and shaped to form a chamber between the one end of the stack and the collecting member;

covering the top and sides of the stack with an air-tight material;

providing an exhaust fan connected to the collecting member so the fan has an inlet communicating with the chamber and an exhaust exterior to the chamber;

supporting the collecting member in a substantially vertical position against the end of the stack; and operating the fan to draw air through the stack of bales, into the chamber, then into the fan inlet and out through the fan exhaust.

* * * * *